US005340695A

United States Patent [19]

Yamaguchi

[11] Patent Number: 5,340,695

[45] Date of Patent: Aug. 23, 1994

[54] SILVER HALIDE PHOTOGRAPHIC MATERIALS

[75] Inventor: Tetsuo Yamaguchi, Kanagawa, Japan

[73] Assignee: Fuji Photo Film Co., Ltd., Kanagawa, Japan

[21] Appl. No.: 104,910

[22] Filed: Aug. 12, 1993

[30] Foreign Application Priority Data

Aug. 25, 1992 [JP] Japan ..... 4-226154

[51] Int. Cl.[5] ..... G03C 1/06

[52] U.S. Cl. ..... 430/264; 430/607; 430/613; 430/957; 430/223; 430/603

[58] Field of Search ..... 430/264, 607, 613, 957, 430/223, 603

[56] References Cited

U.S. PATENT DOCUMENTS 3,193,386 7/1965 White et al. ..... 430/607
3,531,289 9/1970 Wood ..... 430/569
4,520,099 5/1985 Akimura et al. ..... 430/613
5,155,006 10/1992 Goto et al. ..... 430/264
5,190,850 3/1993 Sakai et al. ..... 430/264

FOREIGN PATENT DOCUMENTS 0800958 12/1968 Canada ..... 430/603
0182637 6/1992 Japan ..... 430/603

OTHER PUBLICATIONS

Research Disclosure, Nov. 1989, Item 307105, III, Chemical Sensitization, p. 866.

*Primary Examiner*—Thomas R. Neville
*Attorney, Agent, or Firm*—Sughrue, Mion, Zinn, Macpeak & Seas

[57] ABSTRACT

Disclosed is a silver halide photograhic material which includes a support and at least one emulsion layer. The material also contains a hydrazine derivative and 8-hydroxyguinoline or a derivative thereof. The emulsion may have been subjected to selenium and/or tellurium sensitization.

10 Claims, No Drawings

SILVER HALIDE PHOTOGRAPHIC MATERIALS

FIELD OF THE INVENTION

The present invention concerns silver halide photographic materials and, in particular, it concerns silver halide photographic materials capable of rapidly forming, an ultra-high contrast image which can be used in the field of photographic printing place manufacture, with a processing solution of high stability.

BACKGROUND OF THE INVENTION

Photographic materials which have good original reproduction properties, stable pocessing solutions and simple replenishment are some of the requirements to comply with the demand on diversity and complexity of printed matter in the photographic plate making field.

Original documents for a line work camera process, in particular, are made with a paste-up of photoset text, hand written text, illustrations and screened photographs. Hence, the original documents comprise a mixture of images having different densities and line widths, and there is a demand for plate making cameras, photographic materials and methods of image formation which reproduce the original documents faithfully. On the other hand, enlargement (screen enlargement) or reduction (screen reduction) of screened photographs is widely used in plate making for catalogues and posters. In plate making where screen dots are enlarged, the number of lines is reduced, and blurred dot reproduction occurs. With reduction, the number of lines per inch is greater than on the original document and the dots become finer. Hence, there is a demand on a method for forming images which have a wider latitude for maintaining the reproducibility of screen gradation.

To comply with a demand on the wider latitude, it is known that line images or screen dot images having a clear distinction between image parts and non-image parts and having high contrast and high black densities, are obtained by processing lith-type silver halide photosensitive materials comprising silver chlorobromides (in which the silver chloride content is at least 50%) with a hydroquinone developers, in which the effective concentration of sulfite ion is very low (normally less than 0.1 mol/liter). However, with these methods the developer is very unstable with respect to aerial oxidation because of the low sulfite concentration in the developer. Various endeavors and devices were used to maintain stable bath activity, but at the present time, processing is very slow, thereby deteriorating operational efficiency.

Consequently, a demand has arisen on an image forming system, in which the instability of image formation with development methods, such as those mentioned above (lith development systems), is overcome, with which development is carried out with processing solutions which have good storage stability, and with which ultra-high contrast photographic characteristics can be realized. Systems in which ultra-high contrast negative images of gamma exceeding 10 are formed by processing surface latent image type silver halide photographic materials are proposed. According to the system, the silver halide photographic material containing specified acylhydrazine compounds is processed in developers of pH from 11.0 to 12.3 which contain at least 0.15 mol/liter of sulfite preservative and which have good storage stability, as indicated in U.S. Pat. Nos. 4,166,742, 4,168,977, 4,221,857, 4,224,401, 4,243,739, 4,272,606 and 4,311,781.

The above mentioned image forming systems exhibit excellent performance with respect to sharp screen dot quality, processing stability, speed processability, and original reproduction properties, but further improved systems which are more stable and provide original reproduction properties are desired to satisfy a diversity of printed matter required in recent years.

On the other hand, silver chlorobromide emulsions sensitized by gold or sulfur are used for various reasons in systems containing hydrazine, as disclosed in JP-A-53-20921, JP-A-60-83028. JP-A-60-112034, JP-A-61-249161, JP-A-61-47943, JP-A-62-235947, JP-A-63-103232, JP-A-l-120549 JP-A-2-287532 and JP-A-2-293747. (The term "JP-A" as used herein signifies an "unexamined published Japanese patent application". ) However, a problem arises on the photographic material with respect to increase in photographic speed and deteriorate in black spotting, when it is stored for a prolonged time.

Black spotting results from tiny black particles of developed silvers which are produced in non-exposing regions where no image is formed inherently. Black spotting becomes more prevalent if there is a reduction in the amount of sulfite ion which is generally used in the developer as a preservative and if the pH is raised. Black spotting inevitably reduces greatly a commercial value of a product as a material for photographic plate making purposes.

Furthermore, the abovementioned image forming systems have a disadvantage in that the photographic speed, gamma and the maximum density (Dmax) are reduced by lowering the pH of the developer or increasing the bromide ion concentration in the developer, which result from processing of a large amount of film. On the other hand, in cases where the number of films processed is small, if the sulfite concentration which is introduced as a preservative is reduced markedly or if the pH is raised by the ageing and fatigue of the developer, black spotting becomes remarkable. At the same time, there is a further disadvantage in that the maximum density is reduced. Methods in which the extent of developer replenishment is increased are used to overcome these disadvantages. These methods, however, increase the developer cost and create problems with waste liquids for example. Thus, a system in which there is no increase in the rate of replenishment, without suffering from the change in photographic speed, the fall in $D_{max}$ and the extent of black spotting, is very desirable.

Halogen lamps or Xenon lamps are used as light sources for plate making cameras. Photographic materials are generally subjected to orthochromatic sensitization to obtain a suitable camera speed for these light sources. However, orthochromatically sensitized photographic materials are greatly affected by the chromatic aberration of lenses, and it is clear that this is likely to result in a loss of image quality.

The image systems mentioned above exhibit excellent performance with respect to sharp screen dot quality, processing stability, rapid processability and original reproduction characteristics. But as a result of the diversity of printed material in recent years, a system which has improved original reproduction characteristics is now desirable.

The inclusion of 8-hydroxyquinoline and derivatives thereof in silver halide photographic materials is well known, as disclosed, for example, in U.S. Pat. Nos. 3,193,386 and JP-A-59-42535. However, cases in which hydrazine derivatives are used are unknown.

The use of selenium compounds as chemical sensitizers is already well known. Unstable and/or nonunstable type selenium compounds exist in selenium compounds, and the unstable type selenium compounds are disclosed, for example, in JP-B-44-15748, JP-B-43-13489, JP-A-4-25832, JP-A-4-109240 (The term "JP-B" as used herein signifies an "examined Japanese patent publication".) Examples of unstable type selenium sensitizers include isoselenocyanates (for example, aliphatic isoselenates such as allylisoselenocyanate), selenoureas, selenoketones, selenoamides, selenocarboxylic acids (for example, 2-selenopropionic acid, 2-selenobutyric acid), selenoesters, diacylselenides (for example, bis(3-chloro-2,6-dimethoxybenzoyl)selenide), selenophosphates, phosphineselenides and colloidal metallic selenium.

To those in the industry, the structure of the unstable type selenium compounds as sensitizers for photographic emulsions is of no importance provided that the selenium is unstable. It is generally understood that the organic moiety of the selenium sensitizer molecule has no role other than supporting the selenium in the emulsion in an unstable form.

Non-unstable type selenium compounds are disclosed in JP-B-46-4553, JP-B-52-34492 and JP-B-52-34491, and the compounds disclosed in JP-B-46-4553, JP-B-52-34492 and JP-B-52-34491 can be used as non-unstable type selenium compounds. Examples of non-unstable type selenium compounds include for example, selenous acid, potassium selenocyanide, selenoazoles, quaternary salts of selenoazoles, diarylselenides, diaryldiselenides, dialkylselenides , dialkyldiselenides , 2-selenazolidinedione, 2-selenooxazolidinedione and derivatives of these compounds.

Chemical sensitization using tellurium compounds is disclosed, for example, in Canadian Patent 800,958, British Patents 1,295,462 and 1,396,696, and U.S. Pat. No. 3,531,289. It has been disclosed that this has the effect of increasing the photographic speed of the emulsion. The fact that the chemical sensitization of AgBrCl and AgCl emulsions which was prepared in the presence of organic thioether compounds and rhodium salts was carried out with tellurium compounds is disclosed, particularly in, U.S. Pat. No. 3,531,289.

Furthermore, doping silver halide with tellurium compounds during grain formation is disclosed in U.S. Pat. No. 3,772,031.

Cases in which redox compounds which release a development inhibitor by oxidation are included in systems containing hydrazine compound, are disclosed, for example, in JP-A-61-213847 and JP-A-64-72140.

SUMMARY OF THE INVENTION

A first object of the present invention is to provide silver halide photographic materials which have the photographic characteristics of high photographic speed and high contrast (for example with a gamma value of at least 10), with which there is little increase in photographic speed even when the film is stored for a prolonged period of time, and which are improved with respect to black spotting.

A second object of the present invention is to provide silver halide photographic materials which, in addition to the abovementioned characteristics, exhibit little reduction in density, gamma and $Dma_x$ values even when a developer is deteriorated in that pH is reduced and the bromine ion concentration is increased as a result of processing large amounts of film.

A third object of the present invention is to provide silver halide photographic materials which, in addition to the abovementioned characteristics, have excellent line image quality.

The first object of the present invention is realized by means of a silver halide photographic material comprising a support, having thereon at least one photosensitive silver halide emulsion layer. A hydrazine derivative and a compound which can be represented by formula (I) indicated below are contained in the emulsion layer or in another hydrophilic colloid layer.

Formula (I)

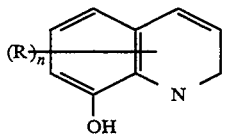

In this formula, R represents a halogen atom (for example, chlorine, bromine, iodine) or an alkyl group (preferably of a carbon number 1–8, for example methyl, ethyl, propyl).

Moreover, n represents 0, or an integer of 1, 2 or 3. When n is 2 or 3, the R individual groups may be the same or different.

The second object of the invention is realized by means of the abovementioned silver halide photographic material in which the silver halide emulsion is chemically sensitized with selenium sensitizer or tellurium sensitizer in an amount of at least $1\times10^{-8}$ mol per mol of silver halide.

The third object of the invention is realized by means of the above mentioned silver halide photographic material in which a redox compound which releases development inhibitor on oxidation is contained.

DETAILED DESCRIPTION OF THE INVENTION

The compounds represented by formula (I) are 8-hydroxyquinoline and derivatives thereof. It is possible by the addition of these compounds to stop the increase in photographic speed and the worsening of black spotting, even when the film is stored for a prolonged period of time. In the general formula, R is preferably a halogen atom among halogen atom and alkyl group, and n is preferably 1 or 2 among 0 to 3.

Examples of compounds represented by formula (I) are listed below, but are not to be construed as being limited thereto according to the present invention:

I-1. 8-Hydroxyquinoline
I-2. 5,7-Dichloro-8-hydroxyquinoline
I-3. 5,7-Dibromo-8-hydroxyquinoline
I-4. 5-Chloro-7-iodo-8-hydroxyquinoline
I-5. 5-Chloro-8-hydroxyquinoline
I-6. 5-Chloro-7-bromo-8-hydroxyquinoline
I-7. 2-Methyl-8-hydroxyquinoline
I-8. 4-Ethyl-8-hydroxyquinoline
I-9. 5-Methyl-8-hydroxyquinoline
I-10. 2-Methyl-5-chloro-8-hydroxyquinoline The compounds represented by formula (I) are generally available commercially and can be obtained easily. But even in those cases where the compound is not available commercially it can be prepared easily in the industry using the method of synthesis described in

*Beilstein* Vol.21, 95, 97, 222 for example, or by following a similar procedure.

The compounds represented by formula (I) may be added in the form of an aqueous solution or in methanol solution to either a photographic emulsion or to a hydrophilic colloid solution for the preparation of a structural layer other than the emulsion layer (for example, a protective layer, a top-coat layer, a filter layer or an intermediate layer).

No particular limitation is imposed upon the time of the addition, but when the addition is made to a photographic emulsion, it is preferably made during or after the second ripening step up to immediately before coating step. The amount added is normally in the range of 0.01 to 10 grams, and most desirably in the range of 0.03 to 1 gram, per mol of silver halide.

The hydrazine derivatives used in the present invention are described below.

The hydrazine derivatives used in the present invention are preferably compounds which can be represented by formula (A) indicated below.

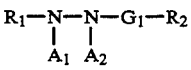

Formula (A)

In this formula, $R_1$ represents an aliphatic group or an aromatic group, $R_2$ represents a hydrogen atom, an alkyl group, an aryl group, an alkoxy group, an aryloxy group, an amino group or a hydrazino group; $G_1$ represents a —CO— group, an —$SO_2$— group, an —SO— group, a —P(O)($R_2$)— group, a —CO—CO— group, a thiocarbonyl group or a iminomethylene group; and $A_1$ an $A_2$ both represent hydrogen atoms or one represents a hydrogen atom and the other represents a substituted or unsubstituted alkylsulfonyl group, or a substituted or unsubstituted arylsulfonyl group, or a substituted or unsubstituted acyl group.

An aliphatic group represented by $R_1$ in formula (A) is preferably a group of a carbon number 1 to 30, most desirably, a linear chain, branched or cyclic alkyl group of a carbon number 1 to 20. This alkyl group may have substituent groups.

An aromatic group represented by $R_1$ in formula (A) is a single- or double-ring aryl group or unsaturated heterocyclic group. Here, an unsaturated heterocyclic group may be condensed with an aryl group.

An aryl group is preferred for $R_1$, and those which contain a benzene ring are especially desirable.

The aliphatic or aromatic groups of $R_1$ may be substituted by substituent groups. Typical substituent groups include, for example, alkyl groups, aralkyl groups, alkenyl groups, alkynyl groups, alkoxy groups, aryl groups, substituted amino groups, ureido groups, urethane groups, aryloxy groups, sulfamoyl groups, carbamoyl groups, alkyl or arylthio groups, alkyl or aryl sulfonyl groups, alkyl or aryl sulfinyl groups, a hydroxy group, halogen atoms, a cyano group, a sulfo group, aryloxycarbonyl groups, acyl groups, alkoxycarbonyl groups, acyloxy groups, carboxamido groups, a sulfonamido group, a carboxyl group, phosphoric acid amido groups, diacylamino groups, imido groups, $R_2$—N-H—CO—N($R_2$)—CO— groups and the like. Examples of preferred substituent groups include alkyl groups (preferably of a carbon number 1 to 20), aralkyl groups (preferably of a carbon number 7 to 30), alkoxy groups (preferably of a carbon number 1 to 20), substituted amino groups (preferably amino groups substituted with alkyl groups of a carbon number 1 to 20), acylamino groups (preferably those of a carbon number 2 to 30), sulfonamido groups (preferably with a carbon number of 1 to 30), ureido groups (preferably of a carbon number 1 to 30), and phosphoric acid amido groups (preferably of a carbon number 1 to 30).

Alkyl groups of a carbon number 1 to 4 are preferred as the alkyl group which can be represented by $R_2$ in formula (A), and single- or double-ring aryl groups (for example, those which contain a benzene ring) are preferred as aryl groups.

When $G_1$ is a —CO— group, the preferred groups from those represented by $R_2$ are, for example, a hydrogen atom, alkyl groups (for example, methyl, trifluoromethyl, 3-hydroxypropyl, 3-methanesulfonamidopropyl, phenylsulfonylmethyl), aralkyl groups (for example, o-hydroxybenzyl) and aryl groups (for example, phenyl, 3,5-dichlorophenyl, o-methanesulfonamidophenyl, 4-methanesulfonamidophenyl, 2-hydroxymethylphenyl). The hydrogen atom is especially desirable as $R_2$.

$R_2$ may be substituted, and the substituent groups described in connection with $R_1$ may be adopted as the substituent groups.

The —CO— group is most desirable for $G_1$ in formula (A).

Furthermore, $R_2$ may be a group which creates a cyclization reaction to form a cyclic constitution containing a part $G_1$-$R_2$ which is cleaved from the rest of the molecule. Examples of the group are disclosed, for example, in JP-A-63-29751.

$A_1$ and $A_2$ are most desirably both hydrogen atoms.

$R_1$or $R_2$ in formula (A) may incorporate with ballast groups or polymers commonly used in immobile photographically useful additives such as couplers. Ballast groups are groups which are comparatively inactive in photographic performance have a carbon number of at least 8. They can be selected, for example, from among the alkyl groups, alkoxy groups, phenyl group, alkylphenyl groups, phenoxy group, alkylphenoxy groups and like groups. Furthermore, examples of polymers are disclosed, for example, in JP-A-1-100530.

$R_1$ or $R_2$ in formula (A) may be incorporated therein a group which is adsorbed very strongly onto a silver halide grain surface. Examples of such absorbing groups include thiourea groups, heterocyclic thioamido groups, mercapto-heterocyclic groups and triazole groups as disclosed, for example, in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Examples of compounds represented by formula (A) are shown indicated below, but the invention is not limited to these compounds:

(A-1)
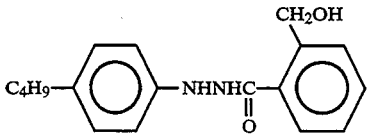
(A-2)
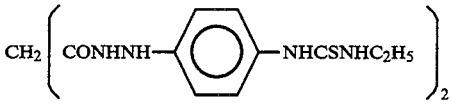
(A-3)
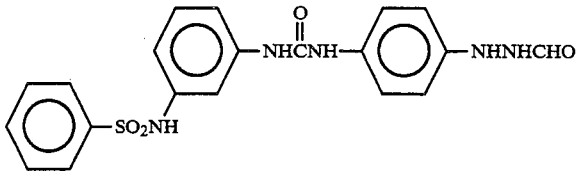
(A-4)
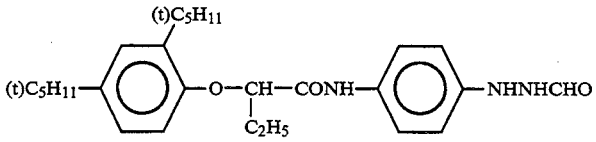
(A-5)
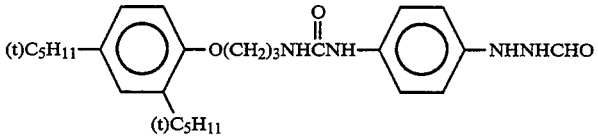
(A-6)
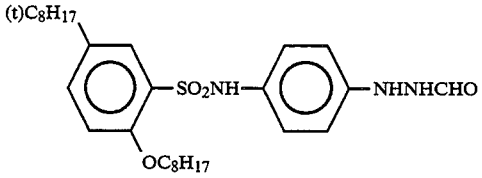
(A-7)
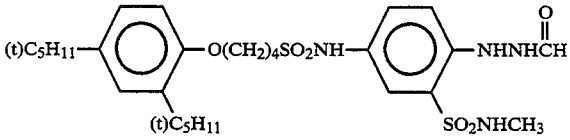
(A-8)
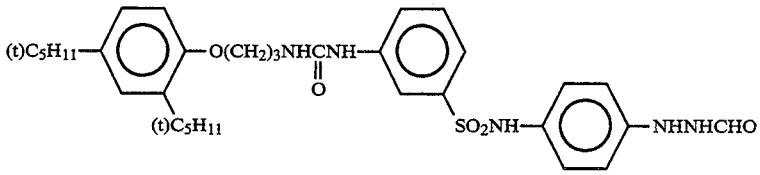
(A-9)
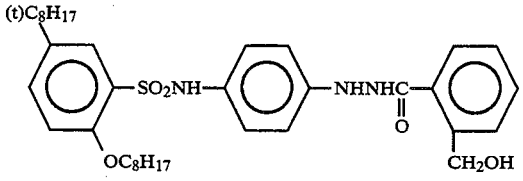
(A-10)
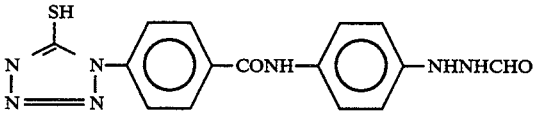

-continued (A-11)

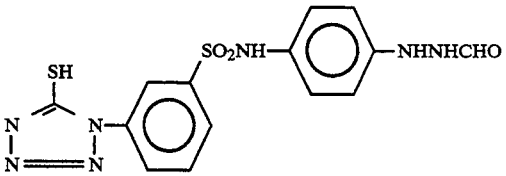

(A-12)

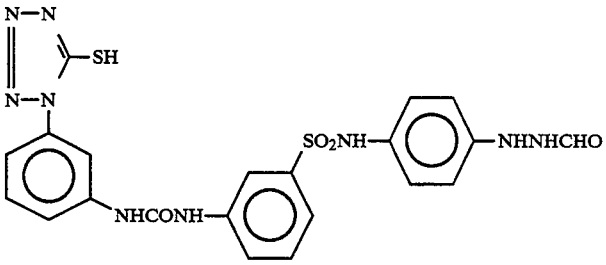

(A-13)

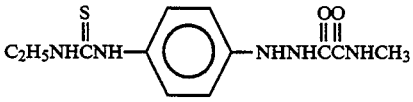

(A-14)

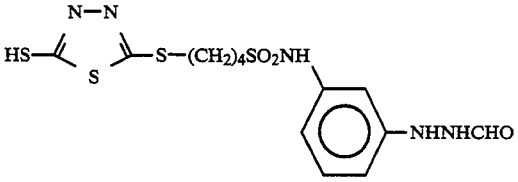

(A-15)

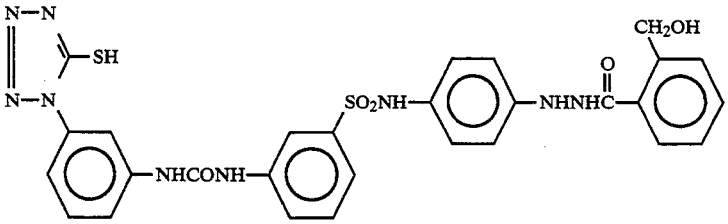

(A-16)

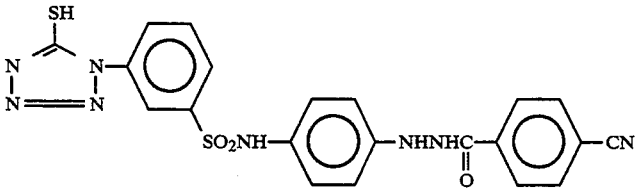

According to the present invention, the emulsion layer or another hydrophilic coloid layer contains a hydrazine derivatives.

The hydrazine derivatives which can be used in the present invention include, in addition to those indicated above, those disclosed in *Research Disclosure* Item 23516 (November 1983, p.346), and in the literature references cited therein, and in U.S. Pat. No. 4,080,207, 4,269,929, 4,276,364, 4,278,748, 4,385,108, 4,459,347, 4,560,638 and 4,478,928, British Patent 2,011,391B, JP-A-2-12236 and JP-A-3-174143.

The amount of hydrazine derivative added in the present invention is preferably in the range from $1\times10^{-6}$mol to $5\times10^{-2}$ mol, and most desirably in the range from $1\times10^{-5}$ to $2\times10^{-2}$ mol, per mol of silver halide.

The conjoint use of a redox compound which releases a development inhibitor as a result of oxidation is desirable in the present invention.

Hydroquinones, catechols, naphthohydroquinones, aminophenols, pyrazolidones, hydrazines, hydroxylamines and reductones are preferred as redox groups of the redox compounds, and the hydrazines are most desirable. Furthermore, a redox compound such that at least part of the development inhibitor can be dissolved out into the developer, which reacts with developer components, and which can be converted to a compound which has low inhibiting properties, is desirable.

The hydrazines which are used as redox compounds which can release a development inhibitor as a result of oxidation of the present invention can be represented by formula (R-1), formula (R-2) or formula (R-3) indicated below:

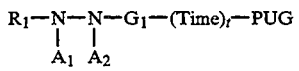

Formula (R-1)

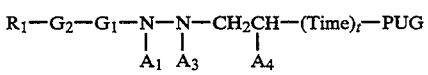

Formula (R-2)

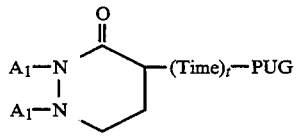

Formula (R-3)

In these formulae, $R_1$ represents an aliphatic group or an aromatic group. $G_1$ represents a —CO— group, a —CO—CO— group, a —CS— group, a —C($NG_2R_2$)— group, an —SO— group, an —$SO_2$— group or a —PO($G_2R_2$)— group. $G_2$ represents a single bond, —O—, —S— or —$NR_2$—, and $R_2$ represents a hydrogen atom or $R_1$.

$A_1$ and $A_2$ represent hydrogen atoms, alkylsulfonyl groups, arylsulfonyl groups or acyl groups, and they may be substituted. In formula (R-1), at least one of $A_1$ and $A_2$ is a hydrogen atom. $A_3$ is the same as $A_1$ or it represents —$CH_2$—CH($A_4$)-(Time)$_t$-PUG.

$A_4$ represents a nitro group, a cyano group, a carboxyl group, a sulfo group or —$G_1$—$G_2$—$R_1$.

Time represents a divalent linking group, and t represents 0 or 1. PUG represents a development inhibitor.

Formulae (R-1), (R-2) and (R-3) are described in more detail below.

In formulae (R-1), (R-2) and (R-3), the aliphatic groups representeded by $R_1$ are preferably groups of a carbon number 1 to 30, and particularly preferably, linear chain, branched or cyclic alkyl groups of a carbon number 1 to 20. These alkyl groups may have substituent groups.

In formulae (R-1), (R-2) and (R-3), the aromatic groups represented by $R_1$ are single- or double-ring aryl groups or unsaturated heterocyclic groups. Here, an unsaturated heterocyclic group may be condensed with an aryl group to form a heteroaryl group.

Examples include a benzene ring, a naphthalene ring, a pyridine ring, a quinoline ring and an isoquinoline ring. Those which contain a benzene ring are preferred.

An aryl group is especially desirable for $R_1$.

The aryl groups and unsaturated heterocyclic groups represented by $R_1$ may be substituted. Typical examples of such substituent groups include alkyl groups, aralkyl groups, alkenyl groups, alkynyl groups, alkoxy groups, aryl groups, substituted amino groups, ureido groups, urethane groups, aryloxy groups, sulfamoyl groups, carbamoyl groups, alkylthio groups, arylthio groups, sulfonyl groups, sulfinyl groups, a hydroxy group, halogen atoms, a cyano group, a sulfo group, aryloxycarbonyl groups, acyl groups, alkoxycarbonyl groups, acyloxy groups, carboxamido groups, sulfonamido groups, a carboxyl group and phosphoric acid amido groups. Preferred substituent groups include linear chain, branched or cyclic alkyl groups (preferably of carbon number 1 to 20), aralkyl groups (preferably of a carbon number 7 to 30), alkoxy groups (preferably of a carbon number 1 to 30), substituted amino groups (preferably amino groups substituted with alkyl groups of a carbon number 1 to 30), acylamino groups (preferably with a carbon number 2 to 40), sulfonamido groups (preferably with a carbon number of 1 to 40), ureido groups (preferably of a carbon number 1 to 40), and phosphoric acid amido groups (preferably of a carbon number 1 to 40).

When $R_1$ represents a substituted aliphatic group, the substituents thereof may be the same as of exemplified above.

A —CO— group or an —$SO_2$— group is preferred for $G_1$ in formulae (R-1), (R-2) and (R-3), and the —CO— group is most desirable.

Hydrogen atoms are preferred for $A_1$ and $A_2$, and a hydrogen atom or —CH2—CH($A_4$)-(Time)$_t$-PUG is preferred for $A_3$.

Time in formulae (R-1), (R-2) and (R-3) represents a divalent linking group, and it may have a timing adjustment function.

The divalent linking group represented by Time represents a group which releases PUG via a single stage or a multiple stage reaction from Time-PUG which is released from the oxidized form of the redox parent.

Examples of divalent linking groups which can be represented by Time include those which release a PUG by way of an intramolecular ring closing reaction of a p-nitrophenoxy derivative as disclosed, for example, in U.S. Pat. No. 4,248,962 (JP-A-54-145135), those which release a PUG by way of an intramolecular ring closing reaction after ring cleavage as disclosed, for example, in U.S. Pat. No. 4,310,612 (JP-A-55-53330) and U.S. Pat. No. 4,358,525, those which release a PUG along with the formation of an acid anhydride by means of the intramolecular ring closing reaction of the carboxyl group of a monoester of succinic acid or a derivative thereof as disclosed, for example, in U.S. Pat. Nos. 4,330,617, 4,446,216 and 4,438,919, and JP-A-59-121328, those with which a PUG is released with the formation of quinomonomethane or a derivative thereof by way of an electron transfer via the conjugated double bonds of an aryloxy group or a heterocyclic oxy group as disclosed, for example, in U.S. Pat. Nos. 4,409,323 and 4,421,845, *Research Disclosure,* No. 21228 (December, 1981), U.S. Pat. No. 4,416,977 (JP-A-57-135944), JP-A-58-209736 and JP-A-58-209738, those which release a PUG from the $\gamma$-position of an enamine by means of electron transfer in a part of a nitrogen containing heterocyclic ring which has an enamine structure as disclosed, for example, in U.S. Pat. No. 4,420,554 (JP-A-57-136640), JP-A-57-135945, JP-A-57-188035, JP-A-58-209737, those which release a PUG by means of an intramolecular ring closing reaction of an oxy group which is formed by electron transfer to a carbonyl group which is conjugated with the nitrogen atom of a nitrogen containing heterocyclic ring as disclosed in JP-A-57-56837, those which release a PUG with the formation of an aldehyde as disclosed, for example, in U.S. Pat. No. 4,146,396 (JP-A-52-90932), JP-A-59-93442, JP-A-59-75475, JP-A-60-249148 and JP-A-60-249149, those which release a PUG with the decarboxylation of a carboxyl group as disclosed in JP-A-51-146828, JP-A-57-179842 and JP-A-59-104641, those which have an —O—COOC$R_a$$R_b$—PUG structure (wherein Ra and Rb, which may be the same or different, each represents a monovalent group and which is a hydrogen atom or has the same significance as of $R_1$) and which release a PUG via the formation of an aldehyde following decarboxylation, those which release a PUG with the formation of an isocyanate disclosed in JP-A-60-7429, and those which release a PUG by means of a coupling reaction with the oxidized form of a color developing agent disclosed, for example, in U.S. Pat. No. 4,438,193.

Examples of the divalent linking groups which can be represented by Time are also described in detail, for example, in JP-A-61-236549, JP-A-1-269936 and JP-A-3-67246.

PUG represents a group which, as $(Time)_t$-PUG or PUG, has a development inhibiting action. PUG is preferably a development inhibitor which, when dissolved out into the developer, can react with a developer component and be converted to a compound which has little inhibiting effect.

Development inhibitors which can be represented by PUG or $(Time)_t$-PUG are known development inhibitors which have a hetero atom and which are bonded via a hetero atom. They have been described, for example, by C. E. K. Mess and T. H. James in *The Theory of the Photographic Processes,* Third Edition, 1967, pages 344 to 346, published by Macmillan.

The development inhibitors represented by PUG may be substituted. The substituent groups, for example, can be cited as examples of substituent groups for $R_1$, and these groups may also be substituted.

The nitro group, the sulfo group, the carboxyl group, the sulfamoyl group, the phosphono group, the phosphinyl group and the sulfonamido group are preferred as substituent groups.

In formulae (R-1), (R-2) and (R-3), $R_1$ or $-(Time)_t$-PUG may incorporate a ballast group or a group which promotes the adsorption of the compound represented by formula (R-1), (R-2) or (R-3) onto silver halide.

Ballast groups are organic groups which provide an adequate molecular weight so that the compound represented by formula (R-1), (R-2) or (R-3) essentially prohibits to diffuse into other layers or into the processing liquids. They are, for example, alkyl groups, aryl groups, heterocyclic groups, ether groups, thioether groups, amido groups, ureido groups, urethane groups, sulfonamido groups or combinations of these groups. Ballast groups which have a substituted benzene ring are preferred as ballast groups, and ballast groups which have a benzene ring which is substituted with branched alkyl groups are especially preferred.

Examples of groups which promote absorption onto silver halides include cyclic thioamido groups such as 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-oxazolin-2-thione, benzimidazolin-2-thione, benzoxazolin-2-thione, benzothiazolin-2-thione, thiotriazine and 1,3-imidazolin-2-thione, chain-like thioamido groups, aliphatic mercapto groups, aromatic mercapto groups, heterocyclic mercapto groups (where there is a nitrogen atom adjacent to the carbon atom to which the —SH group is bonded, this is the same as the cyclic thioamido group with which is related tautomerically, and examples of these groups are as indicated above), groups which have disulfide bonds, five- or six-membered nitrogen containing heterocyclic groups comprising combinations of nitrogen, oxygen, sulfur and carbon atoms, such as benzotriazole, triazole, tetrazole, indazole, benzimidazole, imidazole, benzothiazole, thiazole, thiazoline, benzoxazole, oxazole, oxazoline, thiadiazole, oxathiazole, triazine and azaindene, and heterocyclic quaternary salts such as benzimidazolinium salts.

These groups may be substituted with appropriate substituent groups.

The groups described as such substituent groups for $R_1$, for example, can be cited as such substituent groups.

An oxidation reaction schem of redox compounds according to the present invention is disclosed in JP-A-61-213847 and U.S. Pat. No. 4,684,604.

Examples of redox compounds which can be used in the present invention are indicated below, but the invention is not limited by these examples:

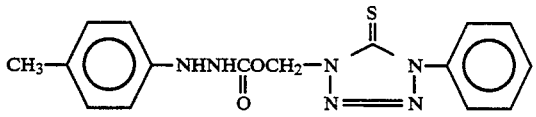

(B-1)

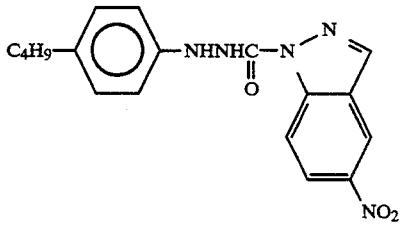

(B-2)

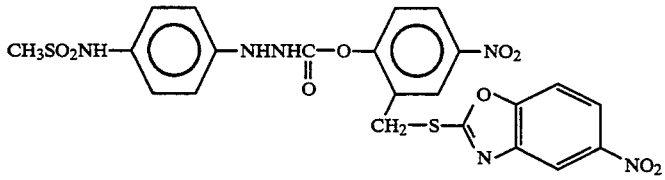

(B-3)

-continued
(B-4)
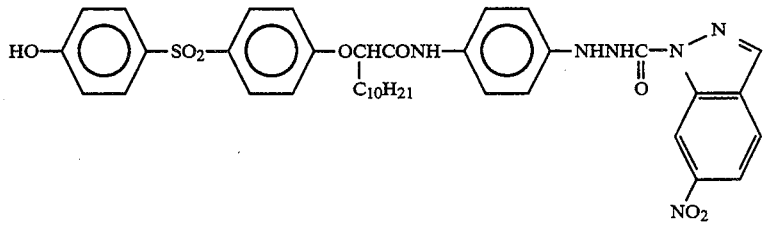
(B-5)
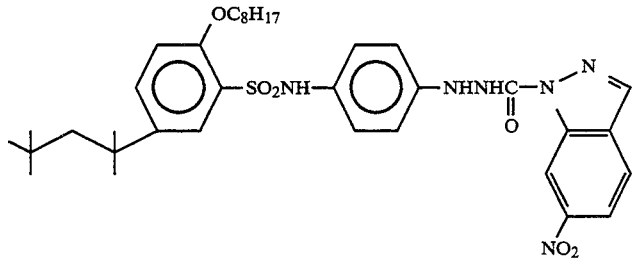
(B-6)
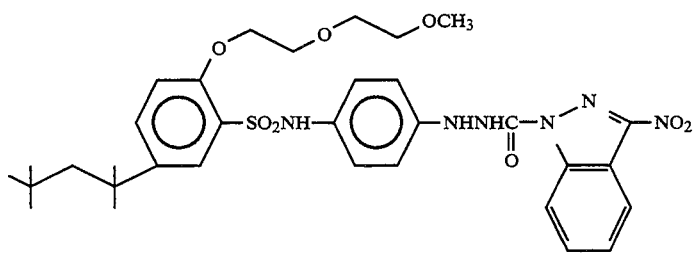
(B-7)
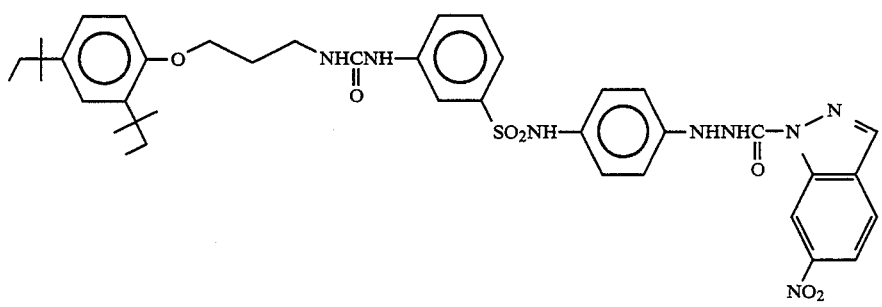
(B-8)
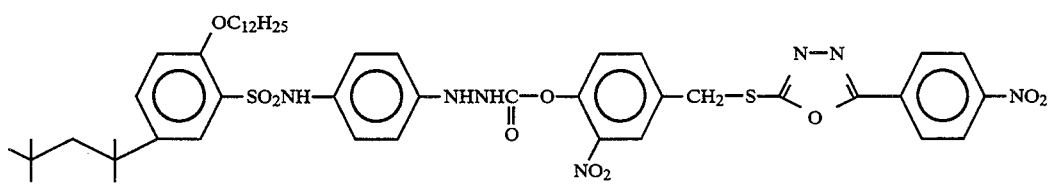
(B-9)
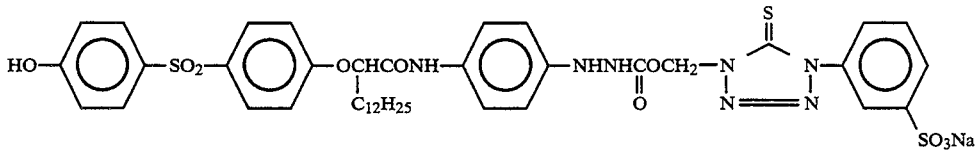
(B-10)
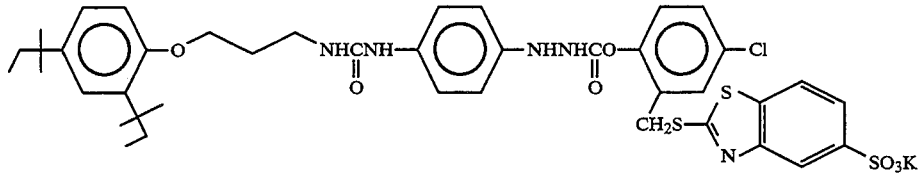

-continued
(B-11)
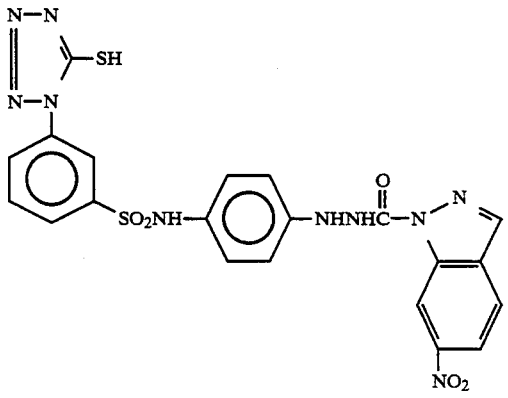
(B-12)
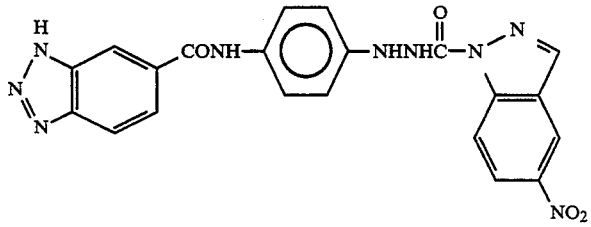
(B-13)
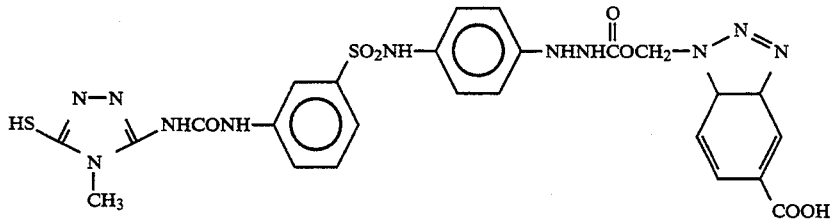
(B-14)
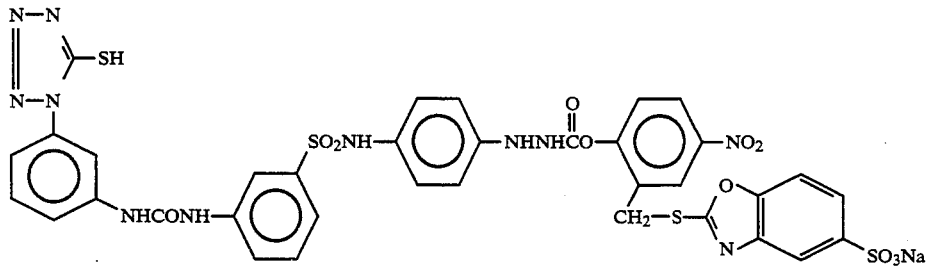
(B-15)
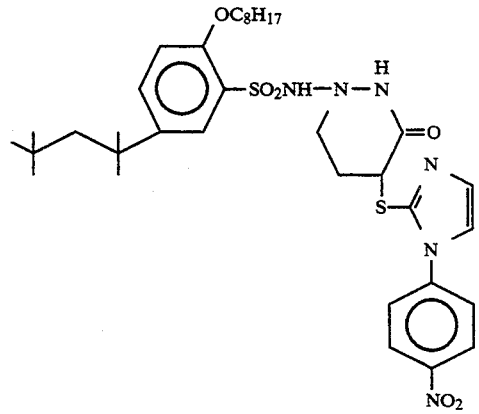

-continued (B-16)

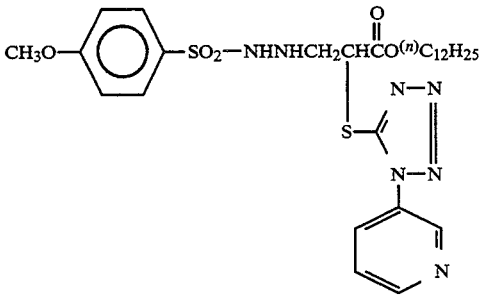

(B-17)

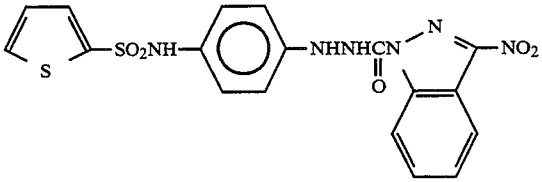

(B-18)

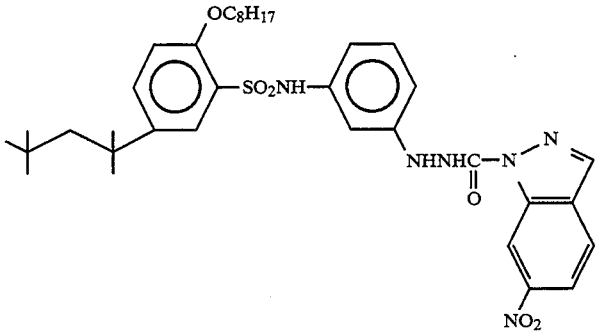

(B-19)

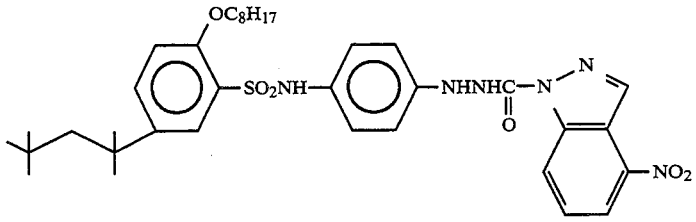

(B-20)

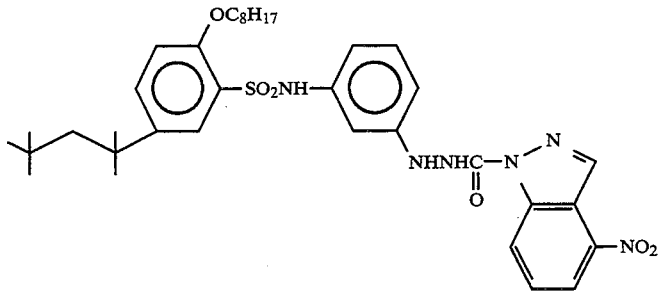

In addition to the compounds indicated above, the compounds (and especially illustrative compound 1–50) represented by formula (I) of JP-A-2-301743, illustrative compound 1–75 of formulae (R-1), (R-2) and (R-3) of JP-A-3-174143, and the compounds disclosed in EP 495477A can be used as the redox compounds which are used in the present invention.

Methods for the synthesis of redox compounds which can be used in the present invention are disclosed, for example, in JP-A-61-213847, JP-A-62-260153, JP-A-1-269936, JP-A-49-129536, JP-A-56-153336 and JP-A-56-153342, U.S. Pat. Nos. 4,684,604, 3,379,529, 3,620,746, 4,377,634 and 4,332,878.

The redox compounds of the present invention can be used in amounts within the range from $1\times10^{-6}$ to $5\times10^{-2}$ mol, and preferably within the range from $1\times10^{-5}$ to $1\times10^{-2}$ mol, per mol of silver halide.

The redox compounds of the present invention can be dissolved in appropriate water-miscible organic solvents, such as alcohols (methanol, ethanol, propanol, fluorinated alcohol), ketones (acetone, methyl ethyl ketone), dimethylformamide, dimethylsulfoxide or methyl cellosolve.

Furthermore, they can also be used by dissolution in an oil such as dibutyl phthalate, tricresyl phosphate, glyceryl triacetate or diethyl phthalate using an auxiliary solvent such as ethyl acetate or cyclohexanone and the formation mechanically of an emulsified dispersion using the well known emulsification and dispersion method. Alternatively, they can be used by dispersing the redox compound powder in water in a ball mill, a colloid mill or ultrasonically, using known methods for solid dispersion.

The layer which contains a redox compound of the present invention may contain silver halide emulsion grains and/or hydrazine derivative, or it may be some other hydrophilic colloid layer.

Examples of locating hydrazine derivatives in photosensitive emulsion layers and locating redox compounds in other hydrophilic colloid layers are disclosed, for example, in EP 395069A.

The layer which contains the redox compound of the present invention may be an upper layer or a lower layer with respect to the photosensitive emulsion layer which contains the hydrazine nucleating agent. The layer which contains a redox compound of the present invention may further contain photosensitive or non-photosensitive silver halide emulsion grains. An intermediate layer which contains gelatin or synthetic polymer (for example, poly(vinyl acetate), poly(vinyl alcohol)) may be provided between the light-sensitive emulsion layer which contains the hydrazine nucleating agent and the layer which contains a redox compound of the present invention.

The halogen composition of the silver halide emulsion which is used in the present invention is not subject to any particular limitation. It may be, for example, silver chloride, silver chlorobromide, silver iodochlorobromide, silver bromide or silver iodobromide, but silver chlorobromides and silver iodochlorobromides which have a silver chloride content of at least 50 mol % based on the told silver halide content thereof are preferred. The silver iodide content is less than 3 mol %, and preferably less than 0.5 mol %. Furthermore, the grains may have a so-called core/shell type structure in which the interior of the grain and the surface layer have a different halogen composition.

The average grain size of the silver halide emulsion in the present invention is preferably not more than 0.5 μm, and most preferably from 0.1 μm to 0.4 μm. The grain size distribution is preferably mono-disperse. Here, the term "mono-disperse" signifies a silver halide emulsion which has a grain size distribution of which the variation coefficient is less than 20%, and preferably less than 15%. Here the variation coefficient (%) is the value obtained by multiplying by 100 the value obtained by dividing the standard deviation of the grain size by the average grain size.

The grains of the present invention may have a regular crystalline form, such as cubic grains, tetradecahedral grains or octahedral grains, or they may have an irregular crystalline form, such as a spherical or tabular form, or they may have a form which is a composite of such crystalline forms. But those which have a regular crystalline form are preferred, and cubic grains are especially preferable.

The silver halide grains may be such that the interior part and the surface layer comprise a uniform, or different phases.

The silver halide grains which are used in the present invention can be prepared using the methods described, for example, by P. Glafkides in *Chemie et Physique Photographique* (Paul Montel, 1967), by G. F. Duffin in *Photographic Emulsion Chemistry* (The Focal Press, 1966), and by V. L. Zelikman et al. in *Making and Coating Photographic Emulsion* (The Focal Press, 1964).

That is to say, the silver halide grains can be prepared using an acidic method, a neutral method or an ammonia method for example, and single sided mixing systems, simultaneous mixing systems and any combination of these systems can be used for carrying out the reaction between the soluble silver salt and the soluble halogen salt. The methods in which grains are formed in the presence of an excess of silver ion (the so-called reverse mixing methods) can also be used.

The method in which the pAg value in the liquid phase in which the silver halide is being formed is held constant, the so-called controlled double jet method, can also be used as a means of simultaneous mixing. If this method is used, a silver halide emulsion of regular grains in which the grain size approaches uniformity can be obtained.

Furthermore, methods in which the rates of addition of the silver nitrate and the alkali halide are varied according to grain growth rate, as disclosed in British Patent 1,535,016, JP-B-48-36890 and JP-B-52-16364, and methods in which the concentration of the aqueous solutions is changed, as disclosed in U.S. Pat. No. 4,242,445 and JP-A-55-158124, can be used to provide a uniform grain size. Rapid growth in the range not exceeding critical saturation is preferred.

Grain formation of the silver halide emulsions of the present invention is preferably carried out in the presence of a silver halide solvent such as tetrasubstituted thiourea or organic thioether compounds.

The compounds disclosed, for example, in JP-A-53-82408 and JP-A-55-77737 are preferred as the tetrasubstituted thiourea silver halide solvents which can be used in the present invention.

The organic thioether silver halide solvents which can be used in the invention are, for example, compounds which have at least one group in which a sulfur atom and an oxygen atom are linked by deviding with ethylene (for example —O—$CH_2CH_2$—S—) as disclosed in JP-B-47-11386 (U.S. Pat. No. 3,574,628) and chain-like thioether compounds which have terminal alkyl groups at both ends (which have at least two substituent groups selected from among hydroxy, amino, carboxy, amido and sulfo) as disclosed in JP-A-54-155828 (U.S. Pat. No. 4,276,374).

The amount of silver halide solvent added differs according to the intended grain size and the halogen composition for example, but an amount of from $10^{-5}$ to $10^{-2}$ mol per mol of silver halide is preferred.

When the grain size becomes larger than intended with the use of a silver halide solvent, the prescribed grain size may be attained by changing the temperature during grain formation and the addition times of the silver salt solution and the halogen salt solution for example.

The silver halide emulsion in the present invention may contain Group VIII metal atoms in Periodic Table, and the inclusion of iridium atoms, rhodium atoms and iron atoms is especially preferable.

The metals included in Group VIII of the Periodic Table are iron, cobalt, nickel, ruthenium, rhodium, palladium, osmium, iridium and platinum. Halides of these metal atoms, their hexa-coordinate complex salts which have halogen atoms, cyano ligands or $H_2O$ as ligands, and the other compounds disclosed in JP-A-63-2042, JP-A-2-20852, JP-A-2-20853 and JP-A-2-20854 can be cited as compounds which contain these metals which can be used desirably in the present invention. These Group VIII metal compounds are used individually, or two or more types may be used conjointly, in an amount corresponding to from $10^{-9}$ mol to $10^{-3}$ mol per mol of silver halide. Among the Group VIII metals, iridium, rhodium and iron salts are preferred, and the conjoint use of two or three of these metal salts can be carried out effectively.

The addition of these compounds can be made appropriately at any stage during the manufacture of the silver halide emulsion and before the emulsion is coated. Moreover, the metal compounds may be added at any stage of nuclei formation and growth during the manufacture of the aforementioned silver halide grains, and they may be added at the time when the silver halide emulsion is being chemically ripened. Addition during the formation of the silver halide grains, and incorporation into the silver halide grains, is especially preferable.

The methods in which an addition is made to the aqueous silver salt solution or the halide solution when the aqueous silver salt solution and the aqueous halide solution are being mixed simultaneously are preferred for the addition of the abovementioned Group VIII metal atoms during grain formation. Alternatively, the silver halide grains may be prepared with a triple simultaneous mixing system using a third solution when the silver salt and the halide solution are being mixed simultaneously. Furthermore, an aqueous solution of the required amount of the Group VIII metal salt can be introduced into the reactor during or immediately after grain formation or during the course, or after the completion, of physical ripening.

The silver halide emulsions used in the present invention are preferably chemically sensitized using selenium and/or tellurium sensitizers.

The known compounds can be used for the selenium sensitizers which are used in the present invention. That is to say, chemical sensitization is carried out generally by adding an unstable type and/or non-unstable type selenium compound and stirring the mixture for a fixed period of time at an elevated temperature of at least 40° C. The compounds disclosed, for example, in JP-B-44-15748, JP-B-43-13489, JP-A-4-25832, JP-A-4-109240 and JP-A-4-324855 can be used as unstable type selenium compounds. The use of the compounds represented by formulae (VIII) and (IX) in JP-A-4-324855 is especially desirable. Concrete examples of compounds are indicated below:

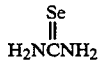
(S-1)

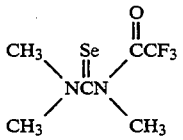
(S-2)

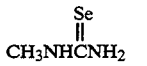
(S-3)

-continued

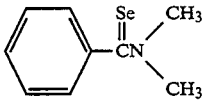
(S-4)

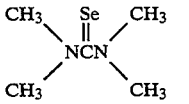
(S-5)

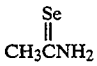
(S-6)

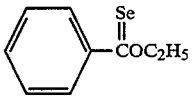
(S-7)

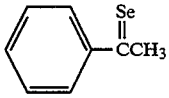
(S-8)

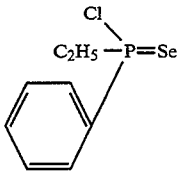
(S-9)

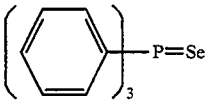
(S-10)

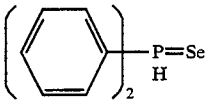
(S-11)

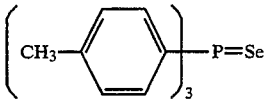
(S-12)

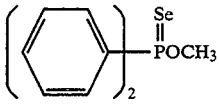
(S-13)

$(nC_4H_9)_3P{=}Se$ (S-14)

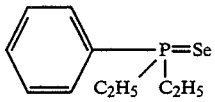
(S-15)

$(C_2H_5O)_3P{=}Se$ (S-16)

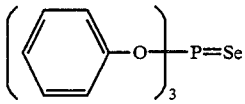
(S-17)

-continued (S-18)

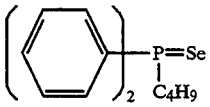

(S-19)

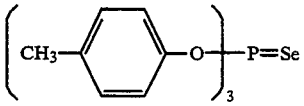

(S-20)

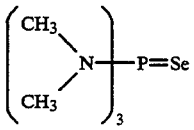

The tellurium sensitizers used in the present invention are compounds which form silver telluride which promotes the formation of sensitization nuclei at the surface of, or within, the silver halide grains. Tests can be carried out using the method in connection with the rate of silver telluride formation in the silver halide emulsion.

In practical terms, use can be made of the compounds disclosed in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333003 and Japanese Patent Application No. 4-129787, *J. Chem. Soc. Chem. Commun.*, 635 (1980), ibid, 1102 (1979), ibid, 645 (1979), *J. Chem. Soc. Perkin Trans.*, 1, 2191 (1980), and (by S. Patai) in *The Chemistry of Organic Selenium and Tellurium Compounds*, Vol. 1 (1986) and ibid, Vol. 2 (1987). The compounds represented by general formulae (II), (III) and (IV) in Japanese Patent Application No. 4-146739 are preferred. Actual compounds are indicated below:

$(nC_4H_9)_3P{=}Te$ (T-1)

(T-2)

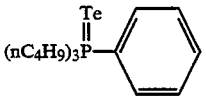

(T-3)

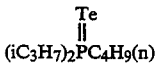

(T-4)

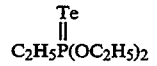

$(nC_4H_9O)_3P{=}Te$ (T-5)

(T-6)

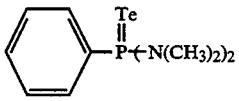

(T-7)

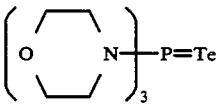

(T-8)

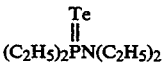

-continued (T-9)

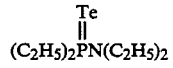

(T-10)

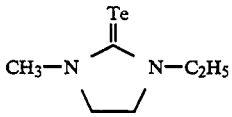

(T-11)

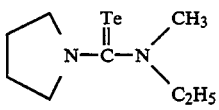

(T-12)

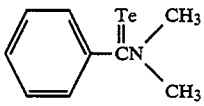

(T-13)

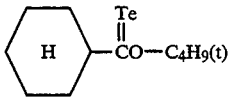

(T-14)

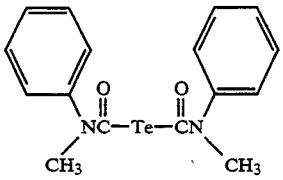

(T-15)

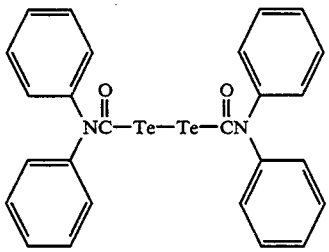

(T-16)

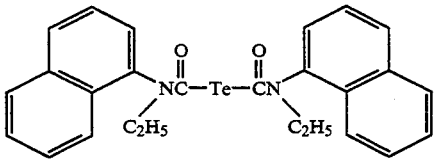

Each amount of the selenium or tellurium sensitizer used in the present invention which is added varies according to the silver halide grain chemical ripening conditions used, for example, but amounts of $10^{-8}$ to $10^{-2}$ mol, and preferably of $10^{-7}$ to $10^{-3}$ mol, per mol of silver halide, are generally used.

No particular limitation in imposed on the chemical sensitization conditions in the present invention, but the pH is preferably 5 to 8, the pAg is 6 to 11, and preferably 7 to 10, and the temperature is 40° to 95° C., and preferably 45° to 85° C.

Noble metal, such as gold, platinum, palladium and indium, sensitizers are preferably used conjointly in the present invention. The conjoint use of gold sensitizers is especially preferable, and actual examples include chloroauric acid, potassium chloroaurate, potassium auricocyanate and gold sulfide in an amount of $10^{-7}$ to $10^{-2}$ mol per mol of silver halide.

Moreover, the conjoint use of sulfur sensitizers is also desirable in the present invention. Known unstable sulfur compounds such as thiosulfate (for example hypo), thioureas (for example diphenylthiourea, triethylthiourea, allylthiourea) and rhodanines can be cited in practice in an amount of $10^{-7}$ to $10^{-2}$ mol per mol of silver halide.

Cadmium salts, lead salts, thallium salts and the like may also be present during the formation and physical ripening of the silver halide grains in a silver halide emulsion used in the present invention.

The complex salts of heavy metals other than gold may also be incorporated.

Reduction sensitization can be used in the present invention. Stannous salts, amines, formamidine sulfinic acid and silane compounds, for example, can be used as reduction sensitizers.

Thiosulfonic acid compounds may be added using the method indicated in European Patent laid open (EP) 293,917 to the silver halide emulsions of the present invention.

The silver halide emulsion in the photosensitive material according to the present invention may be of a single type, or two or more types (which have, for example, different average grain sizes, different halogen compositions, different crystal habits or different chemical sensitization conditions) may be used conjointly.

No particular limitation is imposed upon the various additives which are used in a light-sensitive material of the present invention or on the method of development processing for example, and the use of those disclosed in the locations indicated below is preferred.

| Item | Location |
|---|---|
| 1) Spectrally Sensitizing Dyes | The spectrally sensitizing dyes disclosed from line 13 of the lower left column to line 4 of the lower right column of page 8 of JP-A-2-12236, from line 3 of the lower right column on page 16 to line 20 of the lower left column on page 17 of JP-A-2-103536, and in JP-A-1-112235, JP-A-2-124560, JP-A-3-7928, JP-A-5-11389 and Japanese Patent Application No. 3-411064. |
| 2) Surfactants | From line 7 of the upper right column to line 7 of the lower right column of page 9 of JP-A-2-12236, and from line 13 of the lower left column on page 2 to line 18 of the lower right column of page 4 of JP-A-2-18542 |
| 3) Anti-foggants | From line 19 of the lower right column of page 17 to line 4 of the upper right column, and from line 1 to line 5 of the lower right column, of page 18 of JP-A-2-103526, and the thiosulfinic acid compounds disclosed in JP-A-1-237538. |
| 4) Polymer Latexes | From line 12 to line 20 of the lower left column of page 18 of JP-A-2-103536 |
| 5) Compounds which have Acid Groups | From line 6 of the lower right column on page 18 to line 1 of the upper left column on page 19 of JP-A-2-103536 |
| 6) Matting Agents, Lubricants, Plasticizers | From line 15 of the lower left column of page 19 to line 15 of the upper right column of page 19 of JP-A-2-103536 |
| 7) Dyes | The dyes from line 1 to line 18 of the lower right column on page 17 of JP-A-2-103536, and the solid dyes disclosed in JP-A-2-294638 and JP-A-5-11382 |
| 8) Binders | From line 1 to line 20 of the lower right column on page 3 of JP-A-2-18542 |

-continued

| Item | Location |
|---|---|
| 9) Nucleating Agents | General formulae (II-m) to (II-p) and illustrative compounds II-1 to II-22 from line 13 of the upper right column on page 9 to line 10 of the upper left column of page 16 of JP-A-2-103536, and the compounds disclosed in JP-A-1-179939 |
| 10) Agents for Preventing Black Spotting | The compounds disclosed in U.S. Pat. No. 4,956,257 and JP-A-1-118832 |
| 11) Mono-methine Compounds | The compounds of general formula (II) of JP-A-2-287532 (especially illustrative compounds II-1 to II-26) |
| 12) Dihydroxy benzenes | The compounds disclosed from the upper left column of page 11 to the lower left column of page 12 of JP-A-3-39948 and in EP 452,772A |

There is no need for conventional infectious developers or highly alkaline developers of a pH approaching 13 disclosed in U.S. Pat. No. 2,419,975. Stable developers can be used to obtain photographic characteristics of ultra-high contrast and high photographic speed using a silver halide photosensitive material of the present invention.

Reference can be made to the disclosures made from line 16 of the upper right column on page 19 to line 8 of the upper left column on page 21 of JP-A-2-103536 in connection with the method of development processing for a light-sensitive material of the present invention.

EXAMPLES

The invention is described below in practical terms by means of illustrative examples which are not to be construed as limiting the scope thereof. The formulation of the developer used is indicated below.

| Developer Formulation | |
|---|---|
| Hydroquinone | 50.0 grams |
| N-Methyl-p-aminophenol | 0.3 grams |
| Sodium hydroxide | 18.0 grams |
| 5-Sulfosalicylic acid | 55.0 grams |
| Potassium sulfite | 110.0 grams |
| Ethylenediamine tetra-acetic acid, di-sodium salt | 1.0 gram |
| Potassium bromide | 10.0 grams |
| 5-Methylbenzotriazole | 0.4 grams |
| 2-Mercaptobenzimidazole-5-sulfonic acid | 0.3 grams |
| 3-(5-Mercaptotetrazole)benzenesulfonic acid, sodium salt | 0.2 grams |
| N-n-Butyldiethanolamine | 15.0 grams |
| Sodium toluenesulfonate | 8.0 grams |
| Water to make | 1 liter |
| pH adjusted to 11.8 (with the addition of potassium hydroxide) | pH 11.8 |

EXAMPLE 1

Emulsions A, B and C were prepared using the procedure described below.

Emulsion A: A 0.37M aqueous silver nitrate solution and an aqueous halide solution which contained 0.16M potassium bromide and 0.22M sodium chloride and which also contained $1\times10^{-7}$ mol $K_2Rh(H_2O)Cl_5$ and $2\times10^{-7}$ mol $K_2IrCl_6$ per mol of silver were added using a double jet method over a period of 12 minutes at 38° C. with stirring to a 2% aqueous gelatin solution which contained 0.08M sodium chloride and 1,3-dimethyl-2imidazolidinethione. Nuclei formation was achieved resulting in obtaining silver chlorobromide grains of an average grain size 0.20 μm with a silver chloride content of 65 mol %. Next, a 0.63M aqueous silver nitrate solution and an aqueous halide solution which contained 0.23M potassium bromide and 0.43M sodium chloride, were added in the same way over a period of 20 minutes using a double jet method. Subsequently, conversion was carried out with the addition of a solution of $1\times10^{-3}$ mol KI per mol of silver, water washing was carried out using a deflocculation method in the usual way, 40 grams per mol of silver of gelatin were added, the pH was adjusted to 6.0, and the pAg value was adjusted to 7.3. Then 7 mg of sodium benzenethiosulfonate, 2 mg of benzenesulfinic acid, 8 mg of chloroauric acid and 5 mg of sodium thiosulfate were added, per mol of silver, and chemical sensitization was carried out by heating to 60° C. for 45 minutes. After which, 150 mg of 4-hydroxy-6-methyl-1,3,3*a*,7-tetraazaindene were added as a stabilizer and Proxel was added as a fungicide. The grains obtained were cubic silver chlorobromide grains of an average grain size 0.27 μm with a silver chloride content of 60 mol % (variation coefficient 10%).

Emulsion B: Grain formation and washing were carried out in the same way as for Emulsion A. After adding the gelatin, the pH was adjusted to 5.9, the pAg value was adjusted to 7.3, and then 7 mg of sodium benzenethiosulfonate and 2 mg of benzenesulfinic acid, 5 mg of chloroauric acid, 2 mg of sodium thiosulfate and 1.3 mg of (S-10) as a selenium sensitizer of the present invention were added, per mol of silver. Chemical sensitization was carried out by heating to 60° C. for 45 minutes, after which the stabilizer and fungicide were added in the same way as for Emulsion A. The grains obtained were cubic silver chlorobromide grains of an average grain size 0.27 μm of silver chloride content 60 mol % (variation coefficient 10%).

Emulsion C: Grain formation and washing were carried out in the same way as for Emulsion A. After adding the gelatin, the pH was adjusted to 5.9, the pAg value was adjusted to 7.3, and then 7 mg of sodium benzenethiosulfonate and 2 mg of benzenesulfinic acid, 5 mg of chloroauric acid, 2 mg of sodium thiosulfate and 1.5 mg of (T-16) as a tellurium sensitizer of the present invention were added, per mol of silver. Chemical sensitization was carried out by heating to 60° C. for 45 minutes, after which the stabilizer and fungicide were added in the same way as for Emulsion A. The grains obtained were cubic silver chlorobromide grains of an average grain size 0.27 μm of silver chloride content 60 mol % (variation coefficient 10%).

Next, $1\times10^{-4}$ mol per mol of silver of 5-[3-(4-sulfobutyl)-5-chloro-2-benzoxazolidilidene]ethylidene-1-hydroxyethoxyethyl-3-(2-pyridyl)-2-thiohydantoin, potassium salt were added to the emulsions so obtained. Then $4\times10^{-4}$ mol of the short wave cyanine dye represented by the structural formula (A) indicated below, $3\times10^{-4}$ mol of 1-phenyl-5-mercaptotetrazole, $4\times10^{-4}$ mol of the mercapto compound represented by the structural formula (B) indicated below, $3\times10^{-4}$ mol of the mercapto compound represented by the structural formula (C) indicated below, $4\times10^{-4}$ mol of the triazine compound represented by the structural formula (D) indicated below, a compound of formula (I) of the present invention as shown in Table 1, $8\times10^{-4}$ mol of (A-4) and $4\times10^{-6}$ mol of (A-11) as hydrazine compounds of the present invention, and N-oleyl-N-methyltaurine sodium salt, in such an amount that the coated weight was 30 mg/m², were added. The aqueous latex represented by the structural formula (E) (200 mg/m²) a poly(ethyl acrylate) dispersion (300 mg/m²), and 1,3-divinylsulfonyl-2-propanol (200 mg/m²) as a film hardening agent were added. These emulsions were then coated in such a way as to provide a coated silver weight of 3.6 g/m² onto polyethylene terephthalate films having a sublayer of gelatin.

(A)

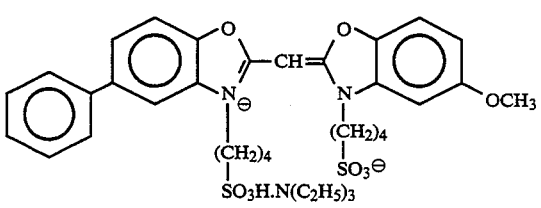

(B)

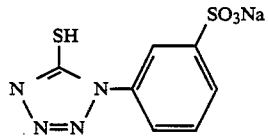

(C)

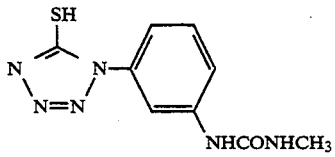

(D)

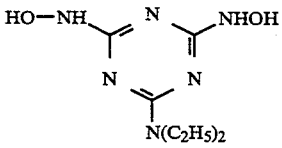

(E)

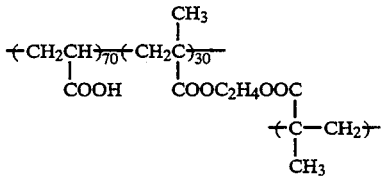

Next, 1.5 g/m² of gelatin, 40 mg/m² of an amorphous $SiO_2$ matting agent of an average particle size about 3.5 μm, 0.1 g/m² of colloidal silica (Snowtex C produced by Nissan Chemical Industries, Ltd.), 50 mg/m² of polyacrylamide, 50 mg/m² of hydroquinone, and silicone oil, Proxel as a fungicide, phenoxyethanol, 5 mg/m² of the fluorine surfactant represented by the structural formula (F) indicated below and 40 mg/m² of sodium dodecylbenzenesulfonate as a coating promoter were coated as a protective layer over these emulsion layers.

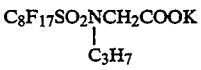

Formula (F)

A backing layer and a protective layer with the formulations indicated below were also coated.

Backing Layer Formulation

-continued

| | |
|---|---|
| Gelatin | 3.3 g/m$^2$ |
| Latex, Poly(ethyl acrylate) | 2 g/m$^2$ |
| Surfactant, Sodium p-dodecylbenzenesulfonate | 40 mg/m$^2$ |
| Fluorine surfactant, the compound represented structural formula (F) as used in the emulsion protective layer | 5 mg/m$^2$ |
| Gelatin Hardening Agent, 1,3-Divinylsulfonyl-2-propanol | 200 mg/m$^2$ |
| Dyes, the mixture of dyes (G), (H) and (I) indicated below: | |
| Dye (G) | 50 mg/m$^2$ |
| Dye (H) | 100 mg/m$^2$ |
| Dye (I) | 50 mg/m$^2$ |

(G)

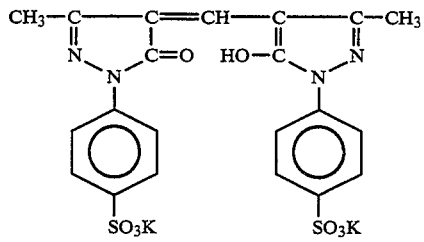

(H)

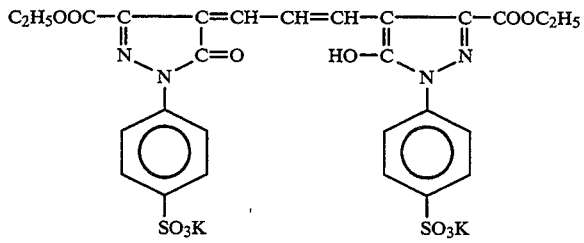

(I)

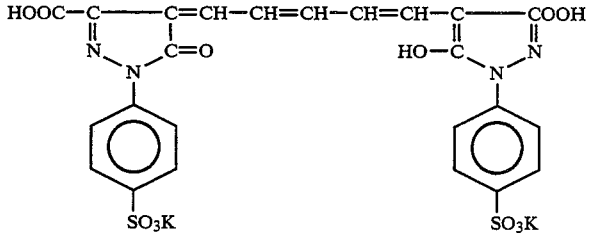

Back Protective Layer

| | |
|---|---|
| Gelatin | 0.8 mg/m$^2$ |
| Fine poly(methyl methacrylate) particles (average particle size 4.5$\mu$) | 30 mg/m$^2$ |
| Dihexyl-$\alpha$-sulfosuccinic acid, sodium salt | 15 mg/m$^2$ |
| Sodium p-dodecylbenzenesulfonate | 15 mg/m$^2$ |
| Sodium acetate | 40 mg/m$^2$ |
| Fluorine Surfactant, the compound of structural formula (F) used in the emulsion protective layer | 5 mg/m$^2$ |

Evaluations were carried out using the methods indicated below.

Photographic Performance 1 shows the results obtained on processing for 30 seconds at 34° C. using an FG-660F automatic processor (made by the Fuji Photographic Film Co.) with the developer formulation described earlier with a sample which had been stored for 7 days at 25° C. in an environment of 55% RH (Conditions 1).

GR-F1 (made by the Fuji Photographic Film Co.) was used for the fixer.

Here, the speed is the relative value of the reciprocal of the exposure which gave a density of 1.5 on development for 30 seconds at 34° C., the value for Sample No. 1 being taken to be 100. Gamma is represented by the following equation.

$$\text{Gamma} = \frac{3.0 - 0.3}{\log(\text{Exposure giving density } 3.0) - \log(\text{Exposure giving density } 0.3)}$$

Black spotting was evaluated in five stages on examining the undeveloped part on development for 40 seconds at 34° C. using a microscope. The quality was represented by a score of "5" for the best and a score of "1" for the worst. Those materials with a score of "5" or "4" could be used in practice, those with a score of "3" were on the border line for practical use, and those with a score of "2" or "1" could not be used in practice.

Photographic Performance 2 shows the results obtained using the same procedure as for Photographic Performance 1 with the developer of which the formulation had been described above after it had been used to process 150 large size (50.8 cm x 61 cm) Fujilith ortho film type GA-100 sheets which had been 100% exposed.

A simulation test for long term storage stability was carried out by subjecting a sample which had been adjusted for 2 hours at 25° C., 40% RH and then heat sealed and stored for 20 days at 40° C. (conditions 2) to an evaluation similar to that of Photographic Performance 1 along with a sample which had been stored for 7 days at 25° C., 55% RH, the conditions of Conditions 1. The usual log value of the reciprocal of the exposure which gave a density of 1.5 on development for 30 seconds at 34° C. was adopted for the photographic speed and the numerical value obtained on subtracting the value for the sample under Conditions 1 from the value for the sample under Conditions 2, Alog E, was taken to show the extent of change in photographic speed. Furthermore, the results obtained with respect to black spotting for the sample under Conditions 2 are indicated for the black spotting performance after prolonged ageing.

The results obtained are shown in Table 1.

TABLE 1

| Sample No. | Emulsion | Compound of General Formula (I) Type | Compound of General Formula (I) Amount Added (mol/mol · Ag) | Photographic Performance 1 Speed | Photographic Performance 1 Gamma | Photographic Performance 2 Speed | Photographic Performance 2 Gamma | Ageing Stability ΔlogE | Ageing Stability Black Spotting | |
|---|---|---|---|---|---|---|---|---|---|---|
| 1 | A | — | — | 100 | 15.0 | 80 | 12.0 | 0.15 | 2 | Comparative Example |
| 2 | " | I-5 | $1 \times 10^{-3}$ | 100 | 15.0 | 80 | 12.5 | 0.06 | 4 | This Invention |
| 3 | " | " | $2 \times 10^{-3}$ | 98 | 15.0 | 77 | 12.0 | 0.04 | 5 | This Invention |
| 4 | " | I-9 | $1 \times 10^{-3}$ | 100 | 15.0 | 80 | 12.0 | 0.07 | 4 | This Invention |
| 5 | " | " | $2 \times 10^{-3}$ | 98 | 15.0 | 77 | 12.0 | 0.05 | 4 | This Invention |
| 6 | B | — | — | 125 | 16.0 | 118 | 15.0 | 0.17 | 2 | Comparative Example |
| 7 | " | I-5 | $1 \times 10^{-3}$ | 125 | 16.0 | 118 | 15.0 | 0.07 | 4 | This Invention |
| 8 | " | " | $2 \times 10^{-3}$ | 120 | 16.0 | 112 | 15.0 | 0.04 | 4 | This Invention |
| 9 | " | I-9 | $1 \times 10^{-3}$ | 125 | 16.0 | 118 | 15.0 | 0.07 | 4 | This Invention |
| 10 | " | " | $2 \times 10^{-3}$ | 122 | 16.0 | 115 | 15.0 | 0.05 | 4 | This Invention |
| 11 | C | — | — | 130 | 16.5 | 122 | 16.0 | 0.17 | 2 | Comparative Example |
| 12 | " | I-5 | $1 \times 10^{-3}$ | 130 | 16.5 | 122 | 15.8 | 0.07 | 4 | This Invention |
| 13 | C | I-5 | $2 \times 10^{-3}$ | 125 | 16.5 | 115 | 16.0 | 0.04 | 4 | This Invention |
| 14 | " | I-9 | $1 \times 10^{-3}$ | 130 | 16.5 | 122 | 15.8 | 0.07 | 4 | This Invention |
| 15 | " | " | $2 \times 10^{-3}$ | 125 | 16.5 | 115 | 15.8 | 0.05 | 4 | This Invention |

As is clear from Table 1, the samples in which a compound of formula (I) of the present invention was included were such that ΔlogE which corresponds to the change in photographic speed after prolonged ageing was remarkably small. They were also good with respect to black spotting, and ageing stability was excellent.

Moreover, the samples in which Emulsion B which was chemically sensitized with a selenium sensitizer was used and the samples in which Emulsion C which was chemically sensitized with a tellurium sensitizer was used were such that the changes in gamma and speed between Performance 1 and Performance 2 were small when compared with the samples in which Emulsion A was used, and their photographic performance with respect to the developer after processing a large quantity of film was also excellent.

EXAMPLE 2

Samples were prepared in the same way as in Example 1 except that Emulsions D and E which was prepared using the selenium compounds represented by (S-6) and (S-7) instead of (S-10) in Emulsion B respectively, and Emulsion F which was prepared using the tellurium compound represented by (T-3) instead of the (T-16) in Emulsion C, were used. On evaluation, the samples constructed in accordance with the present invention exhibited good performance in terms of ageing stability and photographic performance with respect to the developer even after a large quantity of film had been processed.

EXAMPLE 3

Preparation of Hydrazine Containing Emulsions

A sensitizing dye, short wave cyanine dye, mercapto compound and triazine compound were added in the same way as in Example 1 to Emulsions A, B and C used in Example 1 respectively. A compound of formula (I) of the present invention was added as shown in Table 2, and $2\times10^{-3}$ mol/molAg of A-4 was also added as a tellurium compound of the present invention. A dispersion of poly(ethyl acrylate) (500 mg/m$^2$) and 50 mg/m$^2$ of 1,2-bis(vinylsulfonylacetamido)ethane as a film hardening agent were added and hydrazine containing layer coating liquids were prepared.

Preparation of Redox Compound Containing Layer Emulsions

A 1.0M aqueous silver nitrate solution and an aqueous halogen salt solution which contained 0.3M potassium bromide and 0.74M sodium chloride and which also contained $3\times10^{-7}$ mol per mol of silver of $(NH_4)_3RhCl_6$ were added using a double jet method over a period of 30 minutes at 45° C. with stirring to a 2% aqueous gelatin solution which contained 0.08M sodium chloride and 1,3-dimethyl-2-imidazolidinethione. Silver chlorobromide grains of an average grain size 0.30 μm with a silver chloride content of 70 mol % were obtained. Subsequently, conversion was carried out with the addition of a solution of $1\times10^{-3}$ mol KI per mol of silver, water washing was carried out using a deflocculation method in the usual way, 40 grams per mol of silver of gelatin were added, the pH was adjusted to 6.0, and the pAg value was adjusted to 7.6. Then 7 mg of sodium benzenethiosulfonate, 2 mg of benzenesulfinic acid, 8 mg of chloroauric acid and 5 mg of sodium thiosulfate were added, per mol of silver, and chemical sensitization was carried out by heating to 60° C. for 60 minutes. After which, 350 mg of 4-hydroxy-6-methyl1,3,3*a*,7-tetra-azaindene were added as stabilizer and Proxel was added as a fungicide. The grains obtained were cubic silver chlorobromide grains of an average grain size 0.30 μm with a silver chloride content of 70 mol %. (Variation coefficient 9%).

Next, $5\times10^{-4}$ mol per mol of silver of 5-[3-(4-sulfobutyl)-5-chloro-2-benzoxazolidilidene]ethylidene-1-hydroxyethoxyethyl-3-(2-pyridyl)-2-thiohydantoin potassium salt was added to each emulsion so obtained as a sensitizing dye. Then 10 mg/m$^2$ of the dye represented by the structural formula (J) indicated below, a dispersion of poly(ethyl acrylate) (250 mg/m2), 1,3- divinylsulfonyl-2-propanol (30 mg/m$^2$) as film hardening agent and either (B-5) or (B-19) as a redox compound of the present invention as shown hereinafter in Table 2 were added.

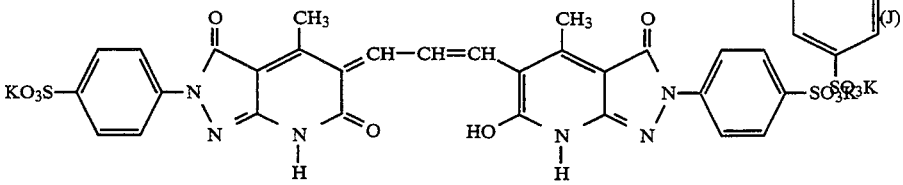

Preparation of an Intermediate Layer Coating Liquid

Ethanethiosulfonic acid, sodium salt 5 mg/m$^2$, 100 mg/m$^2$ of the dye represented by (K), 100 mg/m$^2$ of hydroquinone, 50 mg/m$^2$ of the triol compound represented by (L) and 350 mg/m$^2$ of a dispersion of poly(ethyl acrylate) were added to a gelatin solution to prepare an intermediate layer coating liquid.

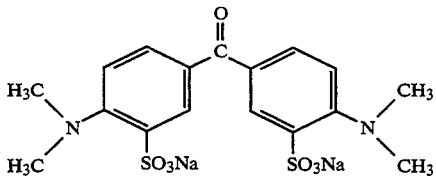

(K)

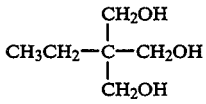

(L)

Then, a 0.2 g/m$^2$ gelatin layer which contained 40 mg/m$^2$ of bis(vinylsulfonyl)methane as a lowest layer, a hydrazine containing layer (Ag 3.4 g/m$^2$, gelatin 1.6 g/m$^2$) and an intermediate layer (gelatin 1.2 g/m2), and then a redox compound containing layer (Ag 0.2 g/m$^2$, gelatin 0.2 g/m$^2$) were coated on a polyethylene terephthalate film on which a gelatin subbing-layer was established. Then 0.3 g/m$^2$ of gelatin, 60 mg/m$^2$ of amorphous $SiO_2$ matting agent of an average particle size about 3.5 μm, 0.1 g/m$^2$ of methanol silica, 50 mg/m$^2$ of liquid paraffin, 5 mg/m$^2$ of the fluorine surfactant indicated by the structural formula (F) used in Example 1 and 20 mg/m$^2$ of sodium dodecylbenzenesulfonate were coated over the top as a protective layer. The samples indicated hereinafter in Table 2 were prepared.

A backing layer of which the formulation indicated below was also coated.

| Backing Layer Formulation | |
|---|---|
| Gelatin | 3.2 g/m$^2$ |
| Surfactant, Sodium p-dodecylbenzenesulfonate | 40 mg/m$^2$ |
| Dihexyl-α-sulfosuccinic acid sodium salt | 40 mg/m$^2$ |
| Gelatin Hardening Agent, 1,3-Divinylsulfonyl-2-propanol Dyes, the mixture of the dye (M) indicated below and dyes (H), (I) and (J) used in Example 1: | 200 mg/m$^2$ |
| Dye (M) | 20 mg/m$^2$ |
| Dye (H) | 50 mg/m$^2$ |
| Dye (I) | 20 mg/m$^2$ |
| Dye (J) | 30 mg/m$^2$ |

(M)

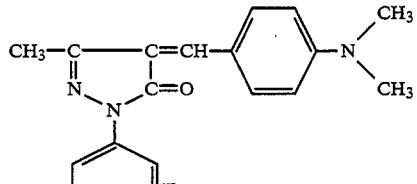

(J)

| Back Protective Layer | |
|---|---|
| Gelatin | 1.3 mg/m$^2$ |
| Fine poly(methyl methacrylate) particles (average particle size 2.5μ) | 20 mg/m$^2$ |
| Sodium p-dodecylbenzenesulfonate | 15 mg/m$^2$ |
| Dihexyl-α-sulfosuccinic acid, sodium salt | 15 mg/m$^2$ |
| Sodium acetate | 60 mg/m$^2$ |

For evaluation, Photographic Performances 1 and 2, black spotting and the ageing stabilities were evaluated in the same way as in Example 1. The photographic speed of Sample No. 16 was taken to be 100. Furthermore, enlargement picture quality was evaluated in the way described below.

(1) Preparation of an Original

A transmission type portrait which was screened and a step wedge in which the screen percentage varied step-wise were prepared using a Monochrome Scanner SCANART 30 and the special use photographic material SF100 made by the Fuji Photo Film Co., Ltd. The screening line number was 150 lines/inch.

(2) Photography

The abovementioned original was set with an enlargement of the same size on a Dainippon Screen Co., Ltd. plate making camera C-440 and evaluation samples were subjected to an exposure to light of a Xenone lamp.

The exposure was controlled in such a way that an area obtained by 95% step wedge of the original may became 5%.

(3) Evaluation

Evaluation was made in five levels (5 to 1) in an order from the best tone reproduction (satisfactory in dots) to the dark tone reproduction at shadow part of the Sample formed by adjusting the exposure to the dot % at a small dot side part (highlight part) as disclosed in (2) above.

The results are shown in Table 2.

TABLE 2

| Sample No. | Emulsion | Compound of General Formula (I) Type | Compound of General Formula (I) Amount Added (mol/mol · Ag) | Redox Compound Type | Redox Compound Amount Added (mol/m$^2$) | Photographic Performance 1 Speed | Photographic Performance 1 Gamma | Photographic Performance 2 Speed | Photographic Performance 2 Gamma | Ageing Stability ΔlogE | Ageing Stability Black Spotting | Image Quality |
|---|---|---|---|---|---|---|---|---|---|---|---|---|
| 16 | A | — | — | — | — | 100 | 14.0 | 80 | 11.5 | 0.15 | 2 | 2 |
| 17 | " | — | — | B-5 | $1 \times 10^{-4}$ | 95 | 12.5 | 75 | 10.0 | 0.13 | 3 | 4 |
| 18 | " | — | — | B-19 | $1 \times 10^{-4}$ | 95 | 12.5 | 75 | 10.0 | 0.13 | 3 | 5 |
| 19 | " | I-5 | $2 \times 10^{-3}$ | — | — | 98 | 14.0 | 78 | 11.5 | 0.05 | 4 | 3 |
| 20 | " | I-9 | $2 \times 10^{-3}$ | — | — | 98 | 14.0 | 78 | 11.5 | 0.05 | 3 | 3 |
| 21 | " | I-5 | $2 \times 10^{-3}$ | B-5 | $1 \times 10^{-4}$ | 95 | 12.5 | 75 | 10.0 | 0.04 | 5 | 5 |
| 22 | " | " | " | B-19 | $1 \times 14^{-4}$ | 95 | 12.5 | 75 | 10.0 | 0.05 | 5 | 5 |
| 23 | " | I-9 | $2 \times 10^{-3}$ | B-5 | $1 \times 10^{-4}$ | 95 | 12.5 | 75 | 10.0 | 0.05 | 4 | 4 |
| 24 | " | " | " | B-19 | $1 \times 10^{-4}$ | 95 | 12.5 | 75 | 10.0 | 0.04 | 5 | 5 |
| 25 | B | — | — | — | — | 125 | 15.0 | 118 | 14.0 | 0.17 | 1 | 2 |
| 26 | " | — | — | B-5 | $1 \times 10^{-4}$ | 120 | 13.0 | 112 | 12.0 | 0.15 | 3 | 4 |
| 27 | " | — | — | B-19 | $1 \times 10^{-4}$ | 120 | 13.0 | 112 | 12.0 | 0.15 | 3 | 4 |
| 28 | " | I-5 | $2 \times 10^{-3}$ | — | — | 122 | 15.0 | 115 | 14.0 | 0.05 | 3 | 3 |
| 29 | " | " | " | B-5 | $1 \times 10^{-4}$ | 118 | 13.0 | 110 | 12.0 | 0.04 | 4 | 4 |
| 30 | " | " | " | B-19 | $1 \times 10^{-4}$ | 118 | 13.0 | 110 | 12.0 | 0.04 | 5 | 5 |
| 31 | C | — | — | — | — | 130 | 15.5 | 122 | 14.5 | 0.18 | 1 | 1 |
| 32 | " | — | — | B-5 | $1 \times 10^{-4}$ | 122 | 13.0 | 115 | 12.0 | 0.15 | 3 | 4 |
| 33 | " | — | — | B-19 | $1 \times 10^{-4}$ | 122 | 13.0 | 115 | 12.0 | 0.15 | 3 | 4 |
| 34 | " | I-5 | $2 \times 10^{-3}$ | — | — | 128 | 15.5 | 122 | 14.5 | 0.06 | 3 | 3 |
| 35 | " | " | " | B-5 | $1 \times 10^{-4}$ | 120 | 13.0 | 112 | 12.0 | 0.05 | 4 | 4 |
| 36 | " | " | " | B-19 | $1 \times 10^{-4}$ | 120 | 13.0 | 112 | 12.0 | 0.05 | 4 | 5 |

As is clear from Table 2, the samples in which a redox compound was used conjointly with a compound of formula (I) of the present invention had excellent ageing stability and the image quality was also good.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support, having thereon at least one lightsensitive silver halide emulsion layer, wherein said emulsion layer or another hydrophilic colloid layer contains a hydrazine derivative and a compound which can be represented by formula (I);

Formula (I)

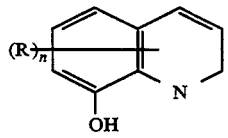

wherein, R represents a halogen atom or an alkyl group, n represents 0, 1, 2 or 3; and when n is 2 or 3, the individual R groups may be the same or different.

2. The silver halide photographic material as in claim 1, wherein the silver halide emulsion has been chemically sensitized with at least $1 \times 10^{-8}$ mol per mol of silver halide of a selenium sensitizer and/or a tellurium sensitizer.

3. The silver halide photographic material as in claim 1, which further comprises a redox compound which releases a development inhibitor on oxidation.

4. The silver halide photographic material as in claim 1, wherein the hydrazine derivative is represented by the following formula (A):

$$R_1-\underset{A_1}{N}-\underset{A_2}{N}-G_1-R_2 \qquad (A)$$

werein $R_1$ represents an aliphatic group or an aromatic group; $R_2$ represents a hydrogen atom, an alkyl group, an aryl group, an alkoxy group, an aryloxy group, an amino group or a hydrazino group; $G_1$ represents —CO—, —$SO_2$—, —SO—, —P(O)($R_2$)—, —CO—CO—, a thiocarbonyl group or an iminomethylene group; and $A_1$ and $A_2$ both represent hydrogen atoms or one represents a hydrogen atom and the other represents a substituted or unsubstituted alkylsulfonyl group, a substituted or unsubstituted arylsulfonyl group, or a substituted or unsubstituted acyl group.

5. The silver halide photographic material as in claim 4, wherein $G_1$ represents —CO— and $R_2$ represents a hydrogen atom.

6. The silver halide photographic material as in claim 3, wherein the redox compound is a hydrazine derivative.

7. The silver halide photographic material as in claim 1, wherein the emulsion layer has a silver chloride content of at least 50 mol % based on the total silver halide content thereor.

8. The silver halide photograhic material as in claim 2, wherein the silver halide emulsion has been chemically sensitized with a selenium sensitizer.

9. The silver halide photographic material as in claim 2, wherein the silver halide emulsion has been chemically sensitized with a tellurium sensitizer.

10. The silver halide photographic material as in claim 1, wherein n represents 1 or 2.

* * * * *